US009147388B2

(12) United States Patent
Uemura et al.

(10) Patent No.: US 9,147,388 B2
(45) Date of Patent: Sep. 29, 2015

(54) AUTOMATIC PERFORMANCE TECHNIQUE USING AUDIO WAVEFORM DATA

(71) Applicant: Yamaha Corporation, Hamamatsu-Shi, Shizuoka-Ken (JP)

(72) Inventors: Norihiro Uemura, Hamamatsu (JP); Takashi Mizuhiki, Hamamatsu (JP); Kazuhiko Yamamoto, Hamamatsu (JP); Atsuhiko Matsushita, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 60 days.

(21) Appl. No.: 13/927,066

(22) Filed: Jun. 25, 2013

(65) Prior Publication Data

US 2013/0340594 A1 Dec. 26, 2013

(30) Foreign Application Priority Data

Jun. 26, 2012 (JP) ..... 2012-142891

(51) Int. Cl.

| | |
|---|---|
| ***G10H 7/00*** | (2006.01) |
| ***G10H 7/04*** | (2006.01) |
| ***G10H 7/02*** | (2006.01) |
| ***G10H 7/06*** | (2006.01) |
| *G10L 21/055* | (2013.01) |

(52) U.S. Cl.

CPC . *G10H 7/04* (2013.01); *G10H 7/02* (2013.01); *G10H 7/06* (2013.01); *G10L 21/055* (2013.01)

(58) Field of Classification Search

CPC ..... A01B 12/006; G10H 7/04; G10H 7/02; G10H 7/06; G10L 21/055

USPC ..... 84/604, 612, 636

See application file for complete search history.

(56) References Cited

U.S. PATENT DOCUMENTS 6,344,607 B2 * 2/2002 Cliff ..... 84/611
7,525,036 B2 * 4/2009 Shotwell et al. ..... 84/611

(Continued)

FOREIGN PATENT DOCUMENTS

JP 2001-312277 A 11/2001

OTHER PUBLICATIONS

Adjusting the Timing of A Multi-Track Performance While Maintaining Phase Relationships, Cakewalk, 2014.*

(Continued)

*Primary Examiner* — Jeffrey Donels
(74) *Attorney, Agent, or Firm* — Morrison & Foerster LLP

(57) ABSTRACT

Waveform data are stored in advance together with reference position information indicative of reference positions, in the waveform data, corresponding to reference timing, such as beat timing, and correction position information indicative of correction positions in the waveform data that are different from the reference positions. The reference timing is advanced when the waveform data are reproduced. In response to arrival of the reference timing, a deviation between a reproduction position of the currently reproduced waveform data and the reference position is evaluated. When the reproduction position arrives at the correction position, the reproduction position is corrected according to the evaluated deviation. Namely, whereas measurement of the deviation, relative to the reference timing, of the currently reproduced waveform data is performed on the basis of the reference position, correction of the current reproduction position of the waveform data for compensating for the measured deviation is performed at the correction position.

13 Claims, 7 Drawing Sheets

(56) References Cited

U.S. PATENT DOCUMENTS

| | | | | |
|---|---|---|---|---|
| 7,982,121 | B2 * | 7/2011 | Randle et al. | 84/611 |
| 8,766,078 | B2 * | 7/2014 | Sugano | 84/612 |
| 2011/0011243 | A1 * | 1/2011 | Homburg | 84/612 |

OTHER PUBLICATIONS

Anonymous. (Apr. 3, 2013). "Adjusting the timing of a multi-track performance while maintaining phase relationships," retrieved from internet: URL:http:f/web.archive.org/web/20130403021347/http://www.cakewalk.com/Documentation/default.aspx?Doc=SONAR%20X2&Lang=EN&Req=Au dioSnap.11.html, retrieved on Nov. 20, 2013, four pages.

Extended European Search Report dated Dec. 2, 2013, for EP Application No. 13173502.9, eight pages.

Ong, B. et al. (Jun. 23, 2008). "Music loop extraction from digital audio signals," Multimedia and Expo, 2008 IEEE International Conference on, IEEE, Piscataway, NJ, USA, pp. 681-684.

Price, S. (Dec., 2006). "Warping 101 in Ableton Live," SOS, Abelton Live Notes & Technique, retrieved from internet: URL:http://www.soundonsound.com/sos/dec06/articles/livetech 1206.htm, retrieved on Nov. 22, 2013, two pages.

* cited by examiner

AUTOMATIC PERFORMANCE TECHNIQUE USING AUDIO WAVEFORM DATA

BACKGROUND

The present invention relates generally to automatic performance techniques for reproducing tones of music (melody or accompaniment) using audio waveform data, and more particularly to a technique for reproducing an automatic performance using audio waveform data and an automatic performance based on control data, such as MIDI data, in synchronism with each other.

There have heretofore been known automatic performance apparatus which prestore an accompaniment pattern data representative of an arpeggio pattern, bass pattern, rhythm pattern and the like of a predetermined unit length, such as a length of four measures, and which perform an automatic performance of tones on the basis of such a prestored accompaniment pattern data. As the accompaniment pattern data, tone waveform signals obtained by sampling an actual musical instrument performance, human voices, natural sounds, etc. (hereinafter referred to also as "audio waveform data") separately for each of performance parts, such as a chord accompaniment part, bass part and rhythm part, are used in some case, and tone control signals defined in accordance with a predetermined standard (i.e., tone generating control data, such as MIDI data defined in accordance with the MIDI standard) are used in another case. Note that, in this specification, the term "tone" is used to refer to not only a musical sound but also a voice or any other sound.

In the case where control data, such as MIDI data, are used as the accompaniment pattern data, the automatic performance apparatus can generate tones at a desired performance tempo, without causing any tone pitch change, by changing a readout speed or rate of event data (more specifically, note events, such as note-on and note-off events). Namely, the automatic performance apparatus can change the performance tempo by change readout timing of the individual event data included in the MIDI data. The tones do not change in pitch because information like note numbers (tone pitch information) of the event data remain the same despite the change in the readout timing of the individual event data.

It is also known that, in the case where audio waveform data are used as the accompaniment pattern data, on the other hand, the automatic performance apparatus can generate tones at a desired performance tempo, without causing any tone pitch change, by performing time stretch control. In this specification, the term "time stretch control" is used to refer to "compressing audio waveform data on the time axis" (time-axial compression) and/or "stretching audio waveform data on the time axis" (time-axial stretch).

Sometimes, a user wants to create a part of the accompaniment pattern data with MIDI data and create another part of the accompaniment pattern data with audio waveform data. When tones are to be reproduced by use of accompaniment pattern data comprising a mixture of the MIDI data and audio waveform data, a performance tempo of the MIDI data (event readout tempo) may sometimes be designated to a tempo different from an original tempo of the audio waveform data (i.e., tempo at which the audio waveform data were recorded). In such a case, a time difference or deviation would occur between tones reproduced on the basis of the MIDI data and tones reproduced on the basis of the audio waveform data. Thus, the audio waveform data are subjected to the above-mentioned time stretch control such that they are stretched or compressed on the time axis to coincide with or match the performance tempo of the MIDI data. However, because errors tend to occur in arithmetic operations performed in the time stretch control, a reproduced tempo of the audio waveform data still cannot accurately match the designated performance tempo (i.e., performance tempo of the MIDI data), so that there would still occur a slight timing difference or deviation between the tones generated on the basis of the audio waveform data and the tones generated on the basis of the MIDI data. Such a time difference or deviation is problematic in that it is accumulated (or piles up) with the passage of time, as a result of which disharmony between the tones would become unignorable to such a degree as to give an auditorily-unnatural impression.

In order to address the aforementioned prior art problem, a more sophisticated technique has been proposed, which is constructed to output tones generated on the basis of audio waveform data and tones generated on the basis of MIDI data in synchronism with each other. For example, a reproduction apparatus disclosed in Japanese Patent Application Laid-open Publication No. 2001-312277 is constructed to change, for each predetermined period (e.g., each measure, beat or 1/16 beat), a reproduction position of audio waveform data at each periodic time point, occurring every such predetermined period, to a predetermined position associated in advance with the predetermined period, in order to allow the reproduction position of audio waveform data to match the reproduction position of corresponding MIDI data every such predetermined period. In this manner, the reproduction position of the audio waveform data is corrected every predetermined period so that the tones generated on the basis of the audio waveform data and the tones generated on the basis of the MIDI data do not greatly differ in time or timing, with the passage of time, to such a degree as to cause disharmony between the tones.

However, in the reproduction apparatus disclosed in the No. 2001-312277 publication, the control for correcting the reproduction position of the audio waveform data is performed merely uniformly each time the predetermined period arrives with no consideration whatsoever of a degree of a reproduction timing deviation per such predetermined period and a waveform state at the corrected reproduction position (more specifically, state of connection of waveforms before and after the reproduction position). Therefore, sound quality of the tones tend to deteriorate to such a degree as to cause an unignorable auditorily-uncomfortable feeling.

SUMMARY OF THE INVENTION

In view of the foregoing prior art problems, it is an object of the present invention to provide a technique for, in reproduction of tones based on audio waveform data, adjusting reproduction timing of the tones in such a manner as to prevent an unnatural reproduction timing deviation even when time stretch control has been performed on the audio waveform data and also preventing sound quality deterioration of reproduced tones due to such adjustment.

It is another object of the present invention to provide a technique for, in a case where music reproduction using audio waveform data and music reproduction using control data, such as MIDI data, are to be executed at a variable tempo in synchronism with each other, permitting appropriate synchronized reproduction of the music without giving an auditorily-unnatural impression.

In order to accomplish the above-mentioned objects, the present invention provides an improved automatic performance apparatus, which comprises: a storage section configured to store therein: waveform data; reference position information indicative of reference positions, in the waveform data, corresponding to reference timing; and correction position information indicative of correction positions in the waveform data that are different from the reference positions; a reference timing advancing section configured to advance the reference timing in accordance with passage of time; a reproduction section configured to reproduce the waveform data, stored in the storage section, in accordance with the passage of time; a measurement section configured to evaluate, in response to arrival of the reference timing, a deviation between a current reproduction position of the waveform data currently reproduced by the reproduction section and the reference position indicated by the reference position information; and a correction section configured to, in response to the current reproduction position of the waveform data arriving at the correction position indicated by the correction position information, correct the current reproduction position of the waveform data, currently reproduced by the reproduction section, in accordance with the deviation evaluated by the measurement section.

According to the present invention, waveform data are stored in advance together with reference position information indicative of reference positions, in the waveform data, corresponding to reference timing and correction position information indicative of correction positions in the waveform data that are different from the reference positions. The reference timing corresponds, for example, to beat timing. With the passage of time, the reference timing is advanced by the reference timing advancing section, and the waveform data are reproduced by the reproduction section. In response to arrival of the reference timing, a deviation between the current reproduction position of the waveform data currently reproduced by the reproduction section and the reference position indicated by the reference position information is evaluated. Further, in response to the current reproduction position arriving at the correction position indicated by the correction position information, the current reproduction position of the waveform data currently reproduced by the reproduction section is corrected in accordance with the evaluated deviation. Namely, whereas the evaluation or measurement of the deviation, relative to the reference timing, of the currently reproduced waveform data is performed on the basis of the reference position, correction of the current reproduction position of the waveform data for compensating for the measured deviation is performed at the correction position. Thus, when no deviation, or only a slight deviation smaller than a threshold value, has been measured as a result of measurement at the reference position, there is no need to correct the current reproduction position in response to arrival of the correction position, so that periodic reproduction position correction as performed in the prior art apparatus is not performed in the present invention. Therefore, the present invention can preclude the possibility of inviting such a degree of sound quality deterioration of tones that would cause an unignorable, auditorily-unnatural feeling as encountered in the prior art apparatus. Further, by selecting, as the correction position of the waveform data, a position where no substantive waveform data exists or where the amplitude level is zero (0) or smaller than a threshold value, i.e. a position which has relatively small importance as a waveform, or a waveform position which has high autocorrelation (namely, a waveform position where a time change of the current reproduction position does not substantially adversely influence quality of a reproduced waveform), the present invention can reliably prevent sound quality of a reproduced tone when correction of the current reproduction position of the waveform data has been performed at the correction position.

Thus, even when time stretch control has been performed in reproduction of tones based on audio waveform data, the present invention can not only adjust the current reproduction position of the waveform data in such a manner as to not invite an unnatural reproduction timing deviation, but also prevent sound quality deterioration of a reproduced tone due to such adjustment. Further, in a case where music reproduction using audio waveform data and music reproduction using control data, such as MIDI data, are to be executed at a variable tempo in synchronism with each other, the present invention can execute appropriate synchronized reproduction of the music without giving an uncomfortable feeling.

The present invention may be constructed and implemented not only as the apparatus invention discussed above but also as a method invention. Also, the present invention may be arranged and implemented as a software program for execution by a processor, such as a computer or DSP, as well as a non-transitory storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
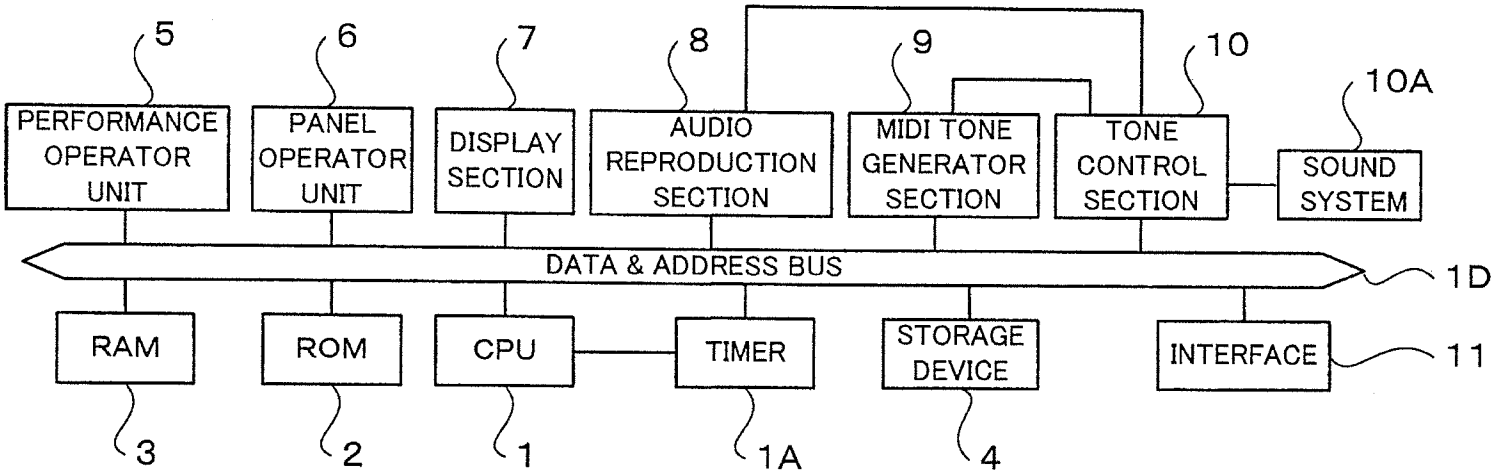
FIG. 1 is a block diagram showing an example general hardware setup of an electronic musical instrument to which is applied an automatic performance apparatus according to a preferred embodiment of the present invention.

FIG. 1 is a block diagram showing an example general hardware setup of an electronic musical instrument to which is applied an automatic performance apparatus in accordance with a preferred embodiment of the present invention. The electronic musical instrument of FIG. 1 performs various processing under control of a microprocessor comprising a microprocessor unit (CPU) 1, a read-only memory (ROM) 2 and a random access memory (RAM) 3. The CPU 1 controls behavior of the entire electronic musical instrument. To the CPU 1 are connected, via a data and address bus 1D, the ROM 2, the RAM 3, a storage device 4, a performance operator unit 5, a panel operator unit 6, a display section 7, an audio reproduction section 8, a MIDI tone generator section 9, a tone control section 10 and an interface 11.

Also connected to the CPU 1 is a timer 1A for counting various times, such as ones to signal interrupt timing for timer interrupt processes. For example, the timer 1A generates tempo clock pulses for setting a performance tempo at which to automatically perform tones and setting a frequency at which to perform time stretch control on audio waveform data. Such tempo clock pulses generated by the timer 1A are given to the CPU 1 as processing timing instructions or as interrupt instructions. The CPU 1 carries out various processes in accordance with such instructions.

The ROM 2 stores therein various programs for execution by the CPU 1 and various data for reference by the CPU 1. The RAM 3 is used as a working memory for temporarily storing various data generated as the CPU 1 executes predetermined programs, as a memory for temporarily storing a currently-executed program and data related to the currently-executed program, and for various other purposes. Predetermined address regions of the RAM 3 are allocated to various functions and used as various registers, flags, tables, temporary memories, etc.

In the storage device 4 is provided a built-in database capable of storing a multiplicity of various data, such as style data sets (see later-described FIG. 2) each comprising a plurality of section data. In addition, various control programs for execution by the CPU 1 may be stored in the storage device 4. Where a particular control program is not prestored in the ROM 2, the control program may be stored in the storage device (e.g., hard disk) 4, so that, by reading the control program from the storage device 4 into the RAM 3, the CPU 1 is allowed to operate in exactly the same way as in the case where the particular control program is stored in the ROM 2. This arrangement greatly facilitates version upgrade of the control program, addition of a new control program, etc.

The external storage device 4 is not limited to the hard disk (HD) and may comprise any of various recording media, such as a flexible disk (FD), compact disk (CD-ROM or CD-RAM), magneto-optical disk (MO) and digital versatile disk (DVD). Alternatively, the storage device 4 may comprise a semiconductor memory.

The performance operator unit 5 is, for example of a keyboard type including a plurality of keys operable to select pitches of tones to be generated and key switches provided in corresponding relation to the keys. The performance operator unit 5 can be used not only for a manual performance by a user or human player itself but also as an input means for entering a chord. Of course, the performance operator unit 5 is not limited to such a keyboard type and may be of any other type or form, such as a neck type having strings for selecting a pitch of each tone to be generated. Namely, in the case where the automatic performance apparatus of the present invention is applied to an electronic musical instrument, the electronic musical instrument is not limited to an instrument of a keyboard type and may be of any other desired type, such as a string instrument type, wind instrument type or percussion instrument type.

The panel operator unit 6 includes, among other things, various operators (operating members), such as a selection switch for selecting a style data set, a section change switch for instructing a change or switchover to any one of section data constituting a style data set, a tempo setting switch for setting a performance tempo, a reproduction (or play) button for instructing start/stop of an automatic performance, an input operator for entering a chord, and setting switches for setting parameters of a tone color, effect, etc. Of course, the panel operator unit 6 may also include a numeric keypad for inputting numeric value data for selecting, setting and controlling a tone pitch, color, effect, etc., a keyboard for inputting character and letter data, and various other operators, such as a mouse operable to operate a predetermined pointer for designating a desired position on any one of various screens displayed on the display section 7.

The display section 7 comprises, for example, a liquid crystal display (LCD) panel, CRT and/or the like. The display section 7 not only displays any of various screens, such as a style selection screen, a performance tempo setting screen and a section change screen, in response to a human operator's operation of any of the above-mentioned switches, but also can various information, such as content of a style data set, and a controlling state of the CPU 1. Further, with reference to these information displayed on the display section 7, the human player can readily perform operations for selecting a style data set, setting a performance tempo and changing a section of a selected style data set.

The audio reproduction section 8, which is capable of simultaneously generating reproduced waveform signals for a plurality of tracks (parts), generates and outputs reproduced waveform signals on the basis of audio waveform data given via the data and address bus 1D. At that time, time-axial stretch/compression control (time stretch control) can be performed for increasing or decreasing reproduced time lengths of the audio waveform data without changing tone pitches of the audio waveform data. For example, when the user has instructed a change in a tempo of a reproduced performance, the audio reproduction section 8 performs the time stretch control on the audio waveform data in accordance with the user-instructed tempo. In the following description, the term "reproduction position" or "current reproduction position" of audio waveform data is used to refer to a reproduction position having been subjected to the time stretch control. Namely, in the instant embodiment, adjustment of the current reproduction position is performed on audio waveform data having been subjected to the time stretch control. Although the time stretch control for adjusting the time axis of audio waveform data can be performed in accordance with any one of various methods, such methods will not be described in detail here because they are known in the art. Further, in the instant embodiment, the audio reproduction section 8 generates and outputs reproduced waveform signals synchronized to tones generated on the basis of MIDI data (i.e., a set of MIDI data).

The MIDI tone generator section 9, which is capable of simultaneously generating reproduced waveform signals for a plurality of tracks (parts), inputs MIDI data given via the data and address bus 1D and generates and outputs reproduced waveform signals on the basis of various event information included in the input MIDI data. The MIDI tone generator section 9 is implemented by a computer, where automatic performance control based on the MIDI data is performed by the computer executing a predetermined application program.

Note that the MIDI tone generator section 9 may be implemented by other than a computer program, such as microprograms processed by a DSP (Digital Signal Processor). Alternatively, the MIDI tone generator section 9 may be implemented as a dedicated hardware device including discrete circuits, integrated or large-scale integrated circuits, and/or the like. Further, the MIDI tone generator section 9 may employ any desired tone synthesis method other than the waveform memory method, such as the FM method, physical model method, harmonics synthesis method or format synthesis method, or may employ a desired combination of these tone synthesis methods.

Further, the audio reproduction section 8 and the MIDI tone generator section 9 are both connected to the tone control section 10. The tone control section 10 performs predetermined digital signal processing on reproduced waveform signals, generated from the audio reproduction section 8 and the MIDI tone generator section 9, to not only impart effects to the reproduced waveform signals but also mix (add together) the reproduced waveform signals and outputs the mixed signals to a sound system 10A including speakers etc. Namely, the tone control section 10 includes a signal mixing (adding) circuit, a D/A conversion circuit, a tone volume control circuit, etc. although not particularly shown.

The interface 11 is an interface for communicating various information, such as various data like style data sets, audio waveform data and MIDI data and various control programs, between the automatic performance apparatus and not-shown external equipment. The interface 11 may be a MIDI interface, LAN, Internet, telephone line network and/or the like, and it should be appreciated that the interface may be of either or both of wired and wireless types.

Furthermore, needless to say, the automatic performance apparatus of the present invention is not limited to the type where the performance operator unit 5, display section 7, MIDI tone generator section 9, etc. are incorporated together as a unit within the apparatus. For example, the automatic performance apparatus of the present invention may be constructed in such a manner that the above-mentioned components are provided separately and interconnected via communication facilities, such as a MIDI interface and various networks.

Also note that the automatic performance apparatus of the present invention may be applied to any other device, apparatus or equipment than an electronic musical instrument, such as a personal computer, a portable communication terminal like a PDA (portable information terminal) or portable telephone, and a game apparatus as long as such a device, apparatus or equipment can execute an automatic performance of tones on the basis of audio waveform data.

Figure 2:
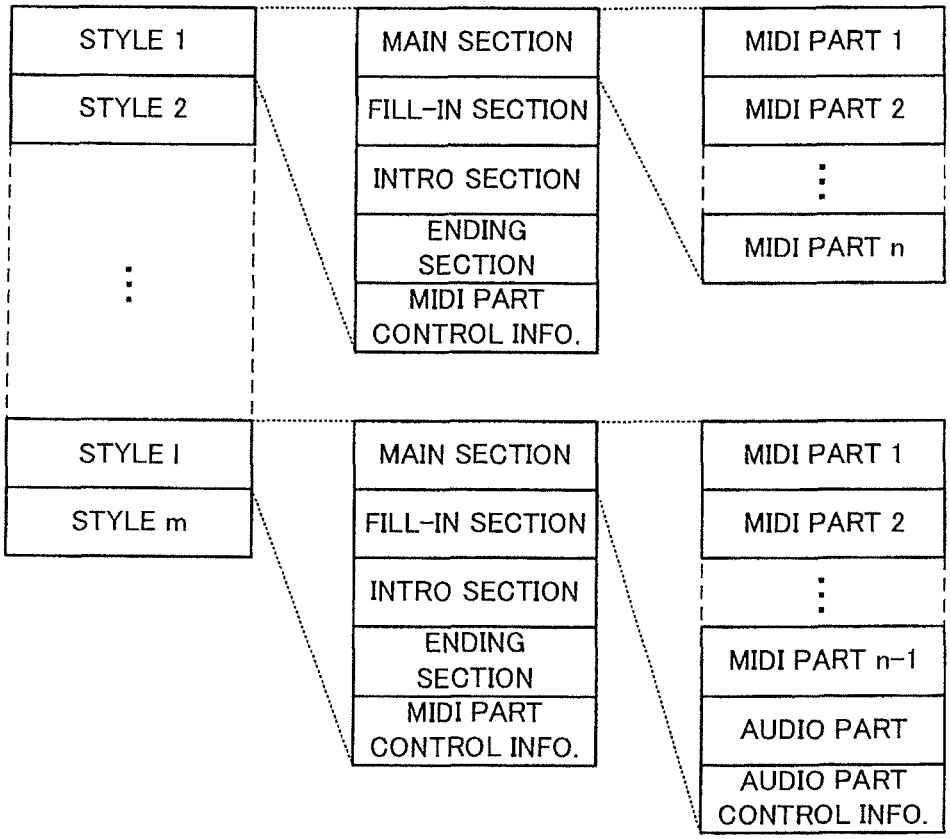
FIG. 2 is a conceptual diagram showing a data structure of style data sets.

FIG. 2 is a conceptual diagram showing a data structure of style data sets stored in a database provided in the electronic musical instrument. Basically, the style data sets are created by a maker of the electronic musical instrument and prestored in the electronic musical instrument. In addition to such prestored style data sets, the user of the electronic musical instrument can not only additionally store, into the database, a style data set newly created by the user, but also additionally acquire a style data set, newly created by the maker or other user and stored in external equipment (such as a server apparatus), and store the thus-acquired style data set into the database in place of or in addition to any one of the prestored style data sets.

Each style data set has, for each of a plurality of sections (namely, main, fill-in, intro, ending sections, etc.), basic accompaniment pattern data provided for individual ones of a plurality of parts, such as chord backing, bass and rhythm parts. The main section is a section where a predetermined pattern of one to several measures is reproduced repetitively, while each of the other sections is where a predetermined pattern is reproduced only once. Upon completion of reproduction of an intro section or fill-in section during automatic performance control, the automatic performance continues to be executed by returning to a main section. But, upon completion of reproduction of an ending section during the automatic performance control, the automatic performance is brought to an end. The user executes an automatic performance of a music piece while switching as desired between sections of a selected style data set. Typically, an automatic performance of a music piece is started with an intro section, then a main section is repeated for a time length corresponding to a play time length of the music piece in question, and then the automatic performance is terminated by switching to an ending section. Further, during reproduction of the main section, a fill-in section is inserted in response to a climax or melody change of the music piece. Note that the lengths of the accompaniment pattern data may differ among the sections and may range from one to several measures.

In the instant embodiment, style data sets (or styles) are classified into two major types: a MIDI style (type) where MIDI data are allocated to all of a plurality of parts (or tracks) as the accompaniment pattern data; and an audio style (type) where audio waveform data are allocated to at least one of the parts (particularly, rhythm part) while MIDI data are allocated to the remaining parts. In FIG. 2, "style 1" is an example of the MIDI style including only MIDI parts, and "style 1" is an example of the audio style including one audio part. The MIDI data are tone control data including a train of MIDI-format events, such as note events and tone generation timing, and the audio waveform data are tone waveform data obtained by sampling an actual musical instrument performance, human voices, natural sounds or the like (see FIG. 3).

The MIDI data are created on the basis of predetermined standard chords and subjected to chord conversion in accordance with a desired chord designated during a performance. The predetermined standard chords are, for example, various chords of the C major key, such as major, minor and seventh, and, once a desired chord is designated by the user during a performance, tone pitches of notes in the accompaniment pattern data are converted to match the designated chord. "MIDI part control information" is information attached to each style and includes control parameters for controlling an automatic performance on the basis of MIDI data among examples of the MIDI part control information is a rule of the chord conversion.

"audio part control information" is information attached to each audio waveform data (more specifically, each audio waveform data set) and includes, for example, tempo information indicative of a tempo at which the audio waveform data was recorded (i.e., basic tempo), beat information (reference position information), sync position information (correction position information), attack information, onset information (switchover position information), etc. Each such audio part control information can be obtained by analyzing corresponding audio waveform data and prestored in a style data set in association with the audio waveform data. In an automatic performance, control is performed on the automatic performance, based on the audio waveform data, with reference to the audio part control information. The following describe, with reference to FIGS. 3A and 3B, details of the audio part control information.

Figure 3A:
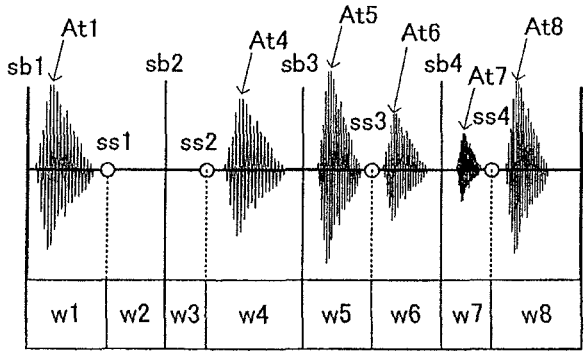
FIGS. 3A and 3B are conceptual diagrams explanatory of audio part control information.

FIG. 3A shows audio waveform data of one measure, constituting an audio part of an audio style, divided, at positions of the beat information (sb1 to sb4) and sync information (ss1 to ss4), into a plurality of waveform segments w1 to w8 in a time-series order. Further, a plurality of waveform blocks included in the waveform segments w1 to w8 are indicated by waveform Nos. (e.g., Mo1-Mo6 and Fo1-Fo9 in FIG. 3B) in an ascending or descending time-series order. As shown, each "waveform block" represents one block of a substantive waveform that forms a rise phase to a decay phase of a single tone. "beat information" (sb1 to sb4) is information indicative of individual beat timing within a measure of the audio waveform data; more specifically, the "beat information" is reference position information indicative of reference positions, in the waveform data, to be synchronized to reference beats given as reference timing. "sync point information" (ss1 to ss4) is correction position information indicative of correction positions in the waveform data that are different from the reference positions. More specifically, the "sync point information" (ss1 to ss4) indicates, as the correction positions, positions in the waveform data where the waveform amplitude is small or autocorrelation is high, or in other words, positions in the waveform data which permit waveform connection unlikely to cause sound quality deterioration when a reproduced waveform signal is generated after correction of a reproduction timing difference or deviation. In response to a current reproduction position of the waveform data arriving at the correction position, the current reproduction position of the waveform data is corrected to compensate for a reproduction timing deviation, as will be later described. The instant embodiment can reliably prevent sound quality deterioration of a reproduced tone, by selecting, as the correction position of the waveform data, a position where no substantive waveform data exists or where the amplitude level is zero (0) or smaller than a threshold value, i.e. a position which has relatively small importance as the waveform or a waveform position which has high autocorrelation (namely, a waveform position where a time or temporal change of the current reproduction position does not adversely influence quality of a reproduced waveform), and correcting the current reproduction position of the waveform data at the correction position. In the instant embodiment, a waveform position where the amplitude level is the smallest in each of segments demarcated by individual beats is set as the sync information, as shown in FIG. 3A. Further, "attack information" (At1, At4, etc.) is each indicative of a waveform position, in a portion from a sounding start to a peak position of one of the waveform segments w1 to w8, which is most recognizable as a tone, e.g. a waveform position where the a variation amount of the amplitude level is the greatest. In the instant embodiment, a peak position where the amplitude level is the greatest is set as the attack information.

Figure 3B:
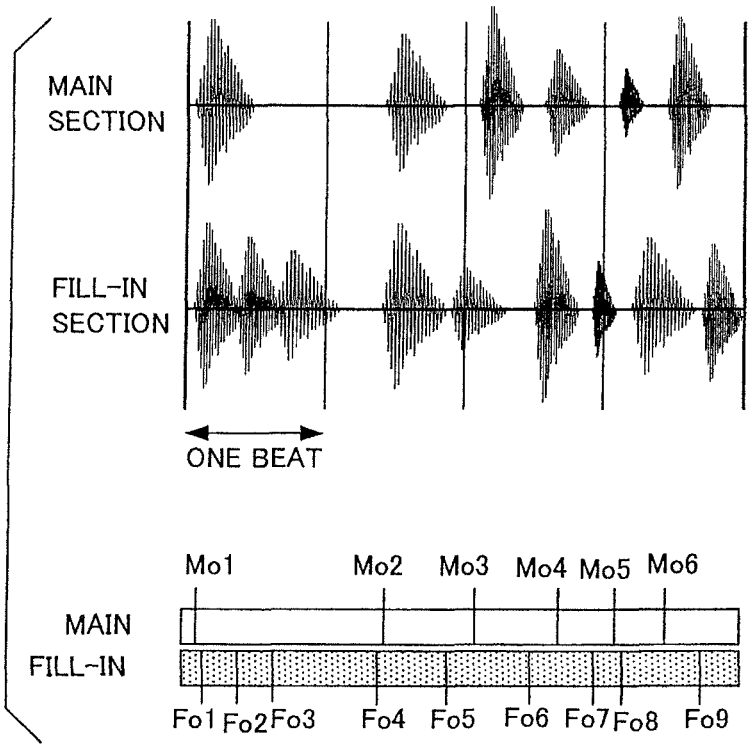

Waveform data of respective one measures of a main section and a fill-in section are shown in an upper region of FIG. 3B, while onset information of the main section and the fill-in section are shown in a lower region of FIG. 3B. The onset information is information to be referenced when control is performed on timing for a switchover between the main section and the fill-in section. In the illustrated example of FIG. 3B, a rise position of each of a plurality of tones (i.e., each of a plurality of peak waveforms) included in the waveform data is defined as the onset information. In the illustrated example of FIG. 3B, the main section has six peak waveforms while the fill-in section has nine peak waveforms. Thus, individual waveforms indicated by reference characters Mo1 to Mo6 and located at rise positions of the six waveforms including the respective peak waveforms in the main section are set as the onset information, in the audio waveform data, of the man section, and individual waveforms indicated by reference characters Fo1 to Fo9 and located at rise positions of the nine waveforms including the respective peak waveforms in the fill-in section are set as the onset information, in the audio waveform data, of the fill-in section.

Note that the structure of the style data sets is not limited to the above-described. For example, stored locations of the style data sets and stored locations of the audio waveform data and MIDI data may be different from each other, in which case information indicative of the stored locations of the audio waveform data and MIDI data may be contained in the style data sets. Also note that the MIDI part control information and the audio part control information may be managed in different locations than the style data sets rather than contained in the respective style data sets. For example, individual MIDI data, audio waveform data, MIDI part control information and audio part control information may be stored in respective different locations than the storage device 4, such as the ROM 2 and/or server apparatus connected to the electronic musical instrument via the interface 11, so that, in reproduction, the same functions as in the above-described embodiment can be implemented by the MIDI data, audio waveform data, MIDI part control information and audio part control information being read out from the respective storage locations into the RAM 3.

Figure 4:
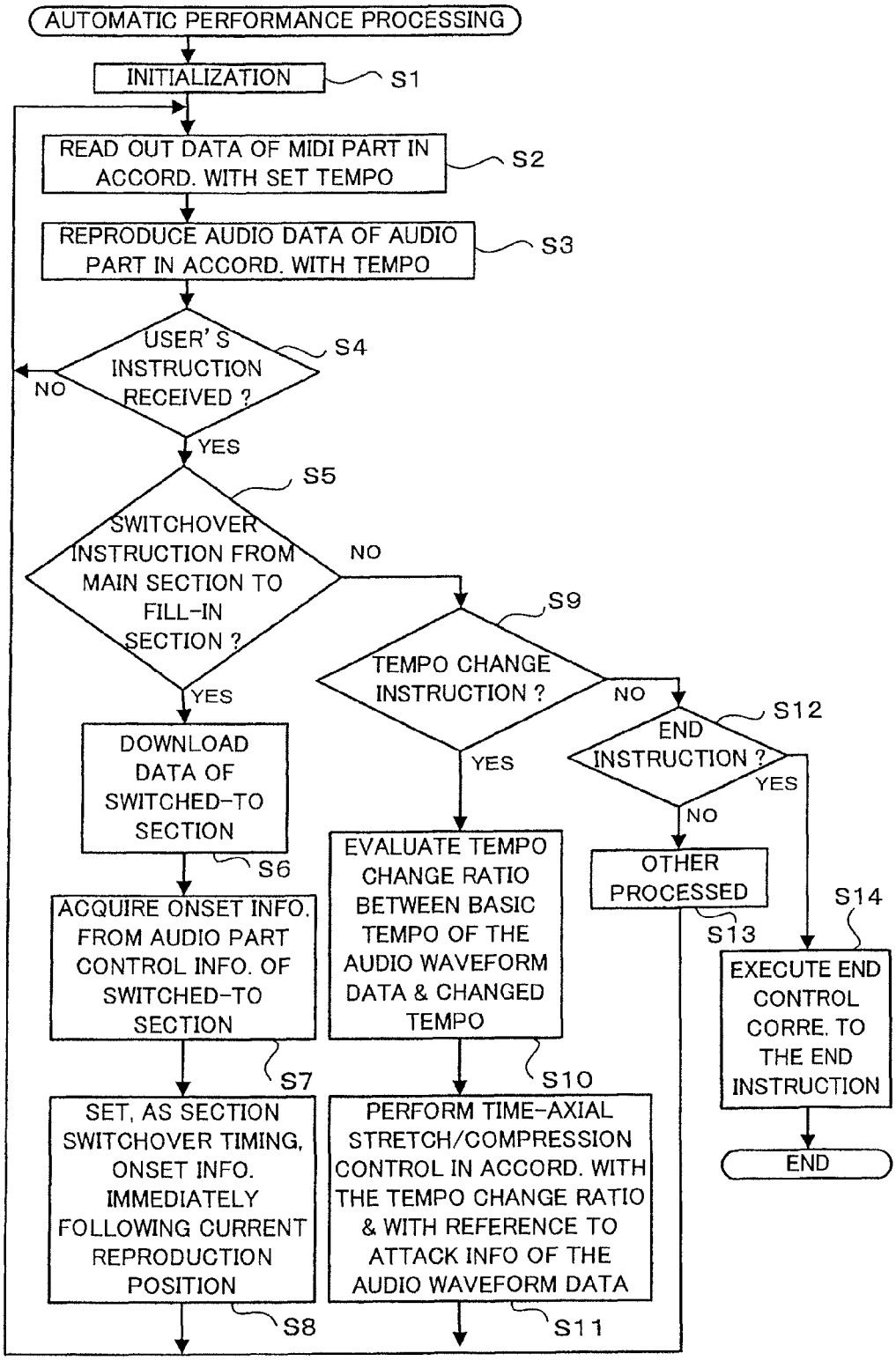
FIG. 4 is a flow chart showing an example operational sequence of automatic performance processing.

Now, a description will be given about "automatic performance processing" performed by the CPU 1, with reference to FIG. 4 that is a flow chart showing an example operational sequence of the automatic performance processing. The automatic performance processing is started in response to an automatic performance start instruction given by the user with a desired audio style data set selected from among a multiplicity of style data sets, and it is terminated in response to an automatic performance end instruction given by the user or upon completion of reproduction of an ending section.

At step S1, an initialization process is performed, which includes, among other things, an operation for setting a performance tempo in response to a user's operation and an operation for reading out, from the ROM 2, storage device 4 and/or the like, the selected style data set together with MIDI data and audio waveform data and storing the read-out data into the RAM 3. At next step S2, an operation for reading out, from the RAM 3, the MIDI data in accordance with the set performance tempo is started for a part having the MIDI data allocated thereto as accompaniment pattern data (such a part will hereinafter be referred to as "MIDI part") in a desired section designated for reproduction from the selected style data set. In response to such MIDI data readout, tones based on the MIDI data are reproduced.

At step S3, an operation for reproducing the audio waveform data in accordance with the set performance tempo is started for a part having the audio waveform data allocated thereto as accompaniment pattern data (such a part will hereinafter be referred to as "audio part"). At that time, if the set performance tempo is different from the basic tempo, control is performed on an automatic performance based on the audio waveform data stored in the RAM 3 in such a manner that tones matching the set performance tempo are generated through time stretch control performed on the audio waveform data. In this way, tones based on the audio waveform data are reproduced. By the aforementioned operations of steps S2 and S3, both the MIDI part and the audio part are reproduced at the performance tempo set by the user; namely, all parts of the style data set are reproduced simultaneously.

At step S4, a determination is made as to whether or not any user's instruction has been received. If no user's instruction has been received as determined at step S4 (NO determination at step S4), the processing reverts to step S2 and awaits a user's instruction while still continuing the reproduction of the MIDI part and the audio part. If, on the other hand, any user's instruction has been received (YES determination at step S4), different operations are performed in accordance with the received user's instruction through a YES route of any one of steps S5, S9 and S12. More specifically, in the illustrated example, any one of different routes of operations are performed depending on whether the received user's instruction is a "section switchover instruction from a main section to a fill-in section" (step S5), a "performance tempo change instruction" (step S9) or an "automatic performance end instruction" (step S12).

If the user's instruction is a "section switchover instruction from a main section to a fill-in section" (YES determination at step S5), operations of steps S6 to S8 are performed, and then the processing reverts to step S2. Note that the reception of the "section switchover instruction from a main section to a fill-in section" means that, the user has instructed, by operating the panel operation unit 6 or the like during reproduction of the main section, that a fill-in section be reproduced. At step S6, audio waveform data and audio part control information of the fill-in section that is a switched-to section are loaded, namely, those audio waveform data and audio part information stored in the storage device 4 are read into the RAM 3. At step S7, onset information is acquired from the audio part control information of the switched-to fill-in section. At next step S8, of the acquired onset information, onset information immediately following a current reproduction position of audio waveform data of the currently reproduced main section (i.e., next onset information) is set as "section switchover timing".

If the user's instruction is a "performance tempo change instruction" as determined at step S9 (YES determination at step S9), operations of steps S10 and S11 are performed, and then the processing reverts to step S2. At step S10, a tempo change ratio between the basic tempo of the audio waveform data and a newly-set performance tempo is evaluated. At next step S11, time stretch control (time-axial stretch/compression control) is performed on the audio waveform data in accordance with the evaluated tempo change ratio. At that time, sound quality deterioration can be reduced by referencing attack information of the audio part control information. The time stretch control is known per se and thus will not be described in detail here.

The aforementioned operations of steps S3, S7, S8, S10, S11 etc. performed by the CPU 1 and the aforementioned audio reproduction section 8 function as a reproduction section constructed or configured to reproduce the audio waveform data, stored in the storage device 4, in accordance with the passage of time.

Further, if the user's instruction is an "automatic performance end instruction" as determined at step S12 (YES determination at step S12), end control corresponding to the automatic performance end instruction is performed, and then the instant automatic performance processing is brought to an end. If, for example, the automatic performance end instruction is an instruction for switching from a main section to an ending section, data reproduction of the ending section is started, in replacing data reproduction of the main section, in a measure immediately following the automatic performance end instruction, and then the instant automatic performance processing is brought to an end after control is performed to reproduce the data of the ending section to the end. If the automatic performance end instruction is a stop instruction given via a reproduction/stop button for stopping the automatic performance, the instant automatic performance processing is brought to an end by data reproduction end control being performed compulsorily in immediate response to the stop instruction.

If the user's instruction is none of the aforementioned instructions (i.e., NO determination has been made at each of steps S5, S9 and S19), other operations corresponding to the user's instruction are performed. Examples of the user's instruction requiring such other operations include a section switchover instruction from a main section to another section than a fill-in section and an ending section, an instruction for muting, or canceling mute of, a desired one of currently reproduced parts, an instruction for switching a style data set and an instruction for changing a tone color or tone volume.

Figure 5:
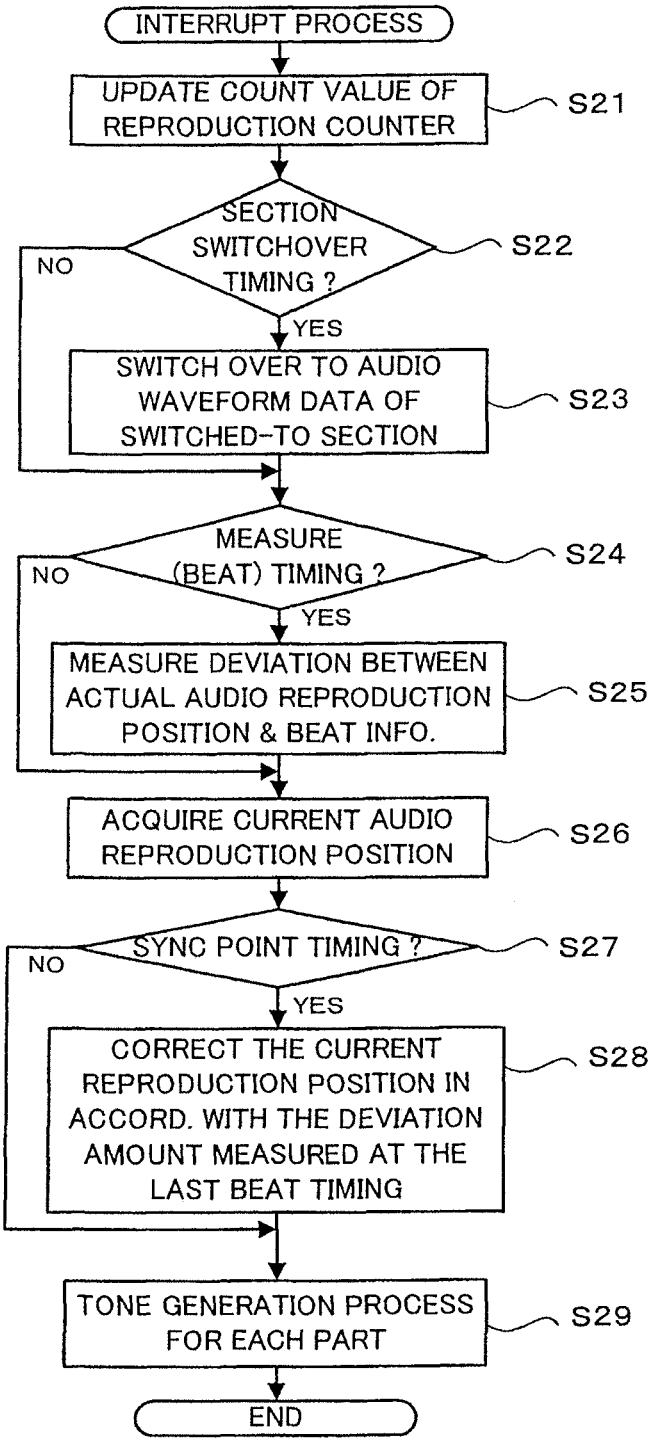
FIG. 5 is a flow chart showing an example operational sequence of an interrupt process.

The following describe an "interrupt process" with reference to FIG. 5 that is a flow chart showing an example operational sequence of the interrupt process. The interrupt process is started repetitively at predetermined time intervals corresponding to clock pulse signals during a time period from the start to end of an automatic performance. Because time intervals between the clock pulse signals differ depending on a performance tempo, the time intervals at which the interrupt process is started (namely, interrupt process timing) change in accordance with a performance tempo change instruction given by the user.

At step S21, a count value of a reproduction counter is incremented by one, namely, value "1" is added to a clock count that starts in response to the start of an automatic performance, each time the interrupt process is started. Art next step S22, a determination is made as to whether or not the count value of the reproduction counter has reached section switchover timing. It is determined that the count value of the reproduction counter has reached section switchover timing, for example, when the count value of the reproduction counter has reached timing set as the "section switchover timing" (see step S8 of FIG. 4), when a switch over to a main section is effected automatically, i.e. when reproduction of an intro section or an ending section has been completed, or when, after a section switchover instruction from a main section to another main section or to an ending section was given, the reproduction position of the switched-from main section has reached a measure boundary position.

If it is determined that the count value of the reproduction counter has reached section switchover timing (YES determination at step S22), audio waveform data to be read out is switched over to audio waveform data of a switched-to section at step S23. Namely, if the user has instructed a switchover from a main section to a fill-in section as determined at step S5 (YES determination at step S5 of FIG. 5), data readout of the fill-in section that is a switched-to section is started once the section switchover timing set at step S8 is reached, instead of the data of the shifted-to fill-in section being read out in immediate response to the user's section switchover instruction. Such switchover control can advantageously reduce generation of noise regardless of the timing of the user's section switchover instruction.

Figure 6:
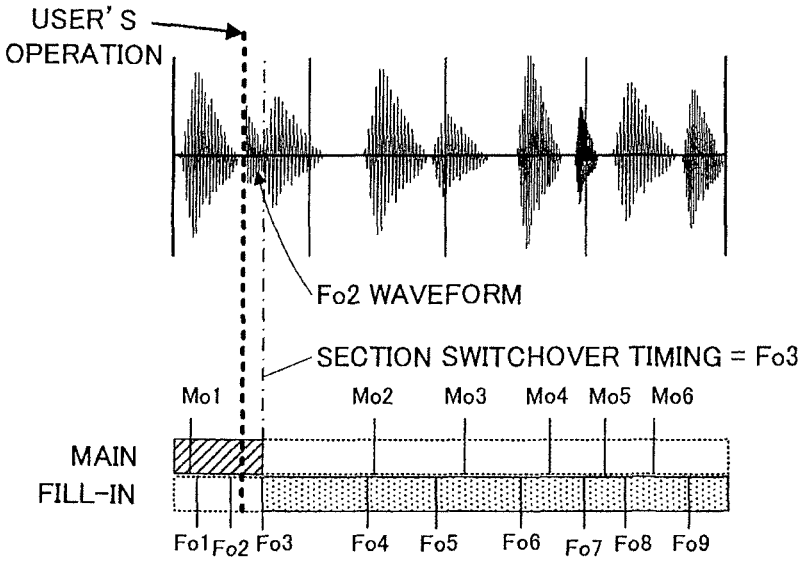
FIG. 6 is a conceptual diagram explanatory of an example of audio waveform data switchover control.
Figure 7:
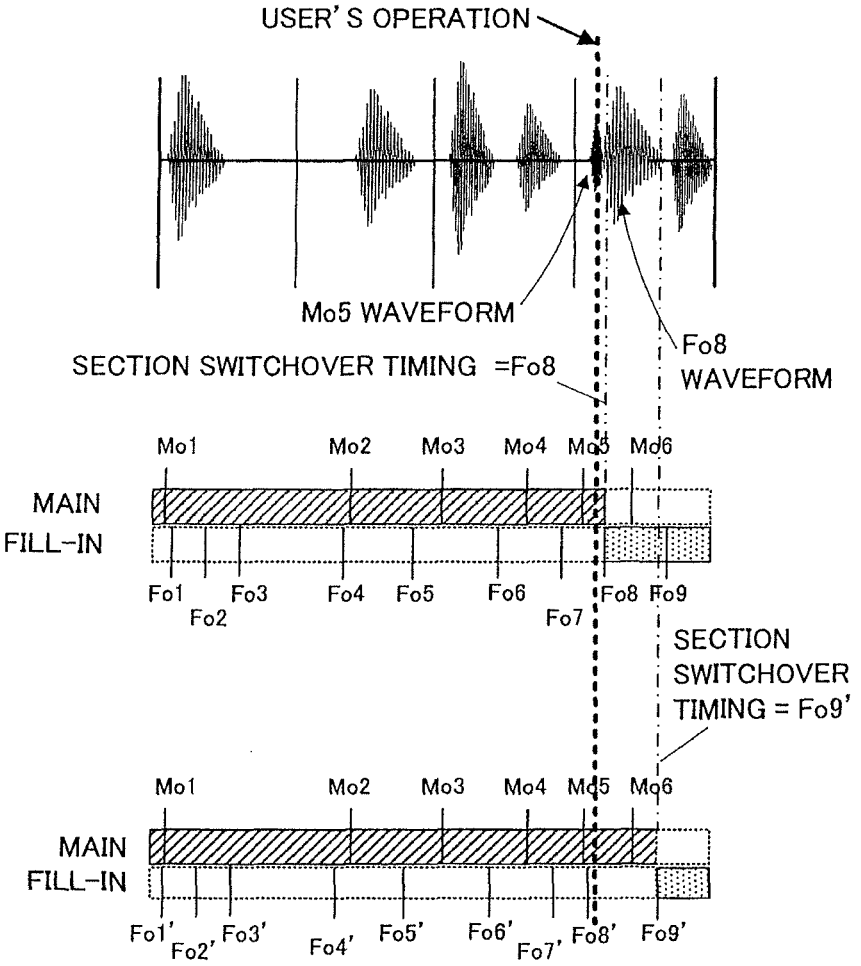
FIG. 7 is a conceptual diagram explanatory of another example of audio waveform data switchover control.

The following describe in detail how audio waveform data switchover between sections is controlled, i.e. how inter-section audio waveform data switchover control is performed, in the instant embodiment, with reference to FIGS. 6 and 7 that are conceptual diagrams showing an example of the inter-section audio waveform data switchover control. Note that the inter-section audio waveform data switchover control will be described below in relation to the example of FIG. 3B where the audio waveform data switchover is from the main section to the fill-in section.

First, with reference to FIG. 6, the inter-section audio waveform data switchover control will be described below in relation to a case where the user has performed a section switchover instructing operation at a time point around the midst of a first beat as indicated by a dotted line in the figure. In this case, if the control for effecting a switchover from the audio waveform data of the main section to the audio waveform data of the fill-in section is performed in immediate response to the user's section switchover instructing operation, reproduction would be started at a halfway or enroute position of a second waveform (whose rise position is Fo2 and which will hereinafter be referred to as "Fo2 waveform") as seen in an upper region of FIG. 6. A tone reproduced at an enroute position of a waveform like this sounds noise, which is inconvenient and undesirable.

As noted above, rise positions (Fo1 to Fo9) of individual waveforms included in the audio waveform data of the fill-in section are set as the onset information of the audio part control information (see FIG. 3B). Thus, in this case, the audio waveform data switchover control is performed in such a manner that, instead of the audio waveform data switchover control being performed in immediate response to the user's section switchover instructing operation, reproduction of the Mo1 waveform of the switched-from main section is maintained until the count value of the reproduction counter reaches the value of the onset information "Fo3" of the switched-to fill-in section immediately after the user's section switchover instructing operation so that reproduction of the waveform data of the fill-in section is started at the head or beginning of the Fo3 waveform in response to the count value of the reproduction counter reaching the value "Fo3" (see a lower region of FIG. 6).

With the aforementioned audio waveform data switchover control, reproduction of the switched-to fill-in section is started at the head or beginning of the Fo3 waveform, not at an enroute position of the Fo2 waveform, so that there is no possibility of noise occurring due to the reproduction from the enroute position of the Fo2 waveform. Note that, in an actual apparatus, loading of waveform data of a switched-to fill-in section is started after a user's section switchover instructing operation and thus would take a while. Therefore, in the instant embodiment, the waveform switchover is effected in response to the count value of the reproduction counter reaching the value of the onset information following and closest to, i.e. immediately following, a time point when the waveform data loading is completed.

Next, with reference to FIG. 7, the inter-section audio waveform data switchover control will be described below in relation to a case where the user has performed a section switchover instructing operation at a time point immediately before the Fo8 waveform as indicated by a dotted line. In this case, if the control for effecting a switchover from the audio waveform data of the main section to the audio waveform data of the fill-in section is performed in immediate response to the user's switchover instructing operation, the Fo8 waveform of the fill-in section wound start sounding immediately after the attack portion (i.e., highest amplitude-level portion) of the Mo5 waveform of the main section sounds (see an upper region of FIG. 7); namely, a so-called "double sounding" phenomenon where two attack tones are generated in a short time period would undesirably occur.

In this case, let it be assumed that the inter-section audio waveform data switchover is effected at a first waveform rise position following the user's switchover instructing operation as in the case of FIG. 6. Namely, reproduction of the Mo5 waveform of the switched-from main section is maintained until the count value of the reproduction counter reaches the value of the onset information "Fo8" of the switched-to fill-in section immediately after the user's switchover instructing operation so that reproduction of the waveform data of the fill-in section is started at the beginning of the Fo8 waveform in response to the count value of the reproduction counter reaching the value "Fo8", as shown in a middle region of FIG. 7. However, even though the waveform data switchover from the main section to the fill-in section is effected at the "Fo8" time point that is a waveform rise position of the fill-in section, the respective attack portions of the Mo5 waveform and the Fo8 waveform are still reproduced in a short time period, and thus, in this case too, "double sounding" phenomenon would undesirably occur.

Therefore, in this case, given waveform positions "Fo1' to Fo9'" slightly earlier than the individual waveform rise positions "Fo1 to Fo9" included in the waveform data of the fill-in section are set in advance as the onset information of the audio part control information, as shown in a lower region of FIG. 7. More specifically, the onset information Fo8 is changed to Fo8' in such a manner the rise position of the Mo5 waveform of the main section and the position Po8' substantially coincide with each other. For the other onset information (Fo1, Fo2, . . . ) too, optimal positions (Fo1', Fo2', . . . ) may be set through comparison between individual waveforms included in the waveform data of the two sections. Namely, the onset information of the audio control data need not necessarily be information indicative of waveform rise positions. Namely, according to the instant setting scheme, the onset information of the switched-to fill-in section immediately following the user's switchover instructing operation is "Fo9'" instead of "Fo8". Thus, the switchover control is performed such that reproduction of the Mo5 waveform of the switched-from main section is maintained until the count value of the reproduction counter reaches the value of the onset information "Fo9'" so that reproduction of the waveform data of the fill-in section is started in response to the count value of the reproduction counter reaching the value "Fo9'". Thus, it is possible to provide a solution to the aforementioned double sounding problem.

Referring back to FIG. 5, a determination is made at step S24 whether or not the count value of the reproduction counter has reached predetermined evaluation or measurement timing, such as timing of a beat (i.e., beat timing). If it is determined that the count value of the reproduction counter has reached the predetermined measurement timing (YES determination of step S24), a deviation of a current reproduction position of the waveform data relative to reference timing (i.e., reproduction position of the MIDI data) is measured at step S25 on the basis of the beat information (sb1-sb4) stored together with the waveform data. Namely, because the beat information (sb1-sb4) is stored in association with the waveform data, a reference position (beat position), in the waveform data, corresponding to each beat timing can be identified by the beat information. The YES determination at step S24 means that the reference timing (i.e., reference beat timing) has been reached. At step S25, measurement is made of a deviation between the current reproduction position of the waveform data and the reference position (i.e., one reference position that should come next) of the waveform data identified by the beat information. If the current reproduction position of the waveform data coincides with the reference position, the deviation is zero (0). If the current reproduction position of the waveform data is ahead of or behind the reference position, the deviation indicates a positive or negative value other than zero. The deviation amount measured at step S25 is temporarily stored into the RAM 3.

The reproduction counter and the CPU 1 that advances the reproduction counter in accordance with a performance tempo, etc. function as a reference timing advancing section that is constructed or configured to advance the reference timing in accordance with the passage of time. Further, the operations of steps S24 and S25 performed by the CPU 1 function as a measurement section that, in response to arrival of the reference timing, measures a deviation between the current reproduction position of the waveform data and the reference position of the waveform data indicated by the reference position information.

With a NO determination at step S24 or after step S25, the interrupt process goes to step S26, where information indicative of the current reproduction position of the waveform data is acquired. At next step S27, a determination is made as to whether or not the acquired current reproduction position of the waveform data coincides with a correction position (i.e., a correction position that should come next, i.e. a sync point), in the waveform data, indicated by the sync point information (ss1-ss4), i.e. whether the acquired current reproduction position coincides with sync point timing. If it is determined that the current reproduction position of the waveform data coincides with the correction position (YES determination at step S27), the current reproduction position of the waveform data is corrected in accordance with the deviation amount measured at the last measurement timing (reference beat timing) to compensate for a time or temporal deviation of the current reproduction position of the waveform data relative to the reference timing (reproduction position of the MIDI data), at step S28. For example, if the current reproduction position of the waveform data is delayed behind the reference timing (reproduction position of the MIDI data), the current reproduction position of the waveform data is corrected to advance by the delay time at a first correction position (sync point) after the measurement timing at which the delay has been detected. Namely, reproduction of the waveform data is continued from the current reproduction position having been corrected to advance, as will be later described in detail with reference to FIG. 8. The operation of step S28 performed by the CPU 1 functions as a correction section that, in response to the current reproduction position of the waveform data reaching the correction position (sync point) indicated by the correction position information (sync point information), corrects the current reproduction position of the waveform data in accordance with the measured or evaluated deviation. At next step S29, a tone generation process is performed for each of the parts; for example, if there is any MIDI event at the current timing, generation or deadening of a tone and any other tone generation control operation are performed on the basis of the MIDI event.

Figure 8:
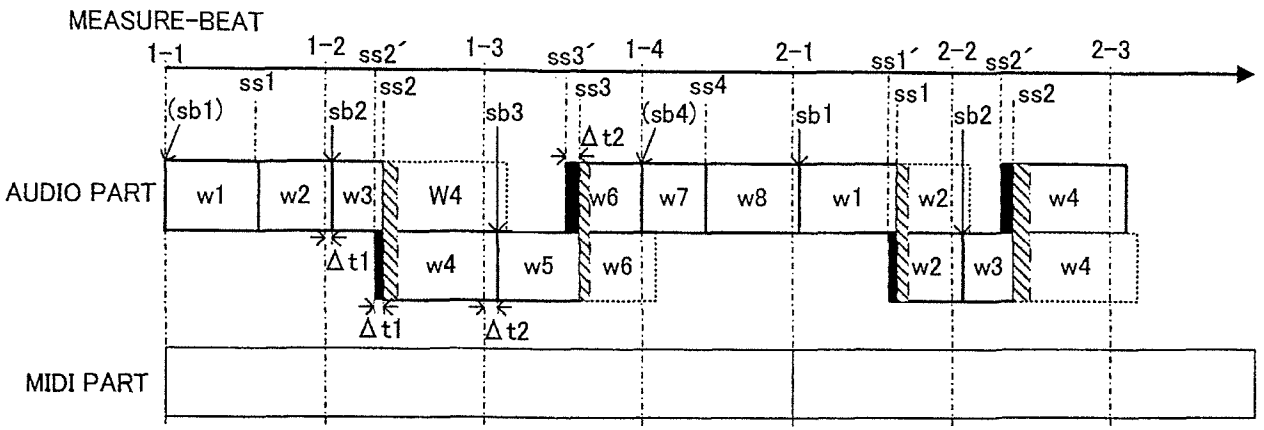
FIG. 8 that is a conceptual diagram explanatory of timing deviation correction of the audio waveform data.

The following describe a timing deviation between the reference timing (i.e., reproduction position of the MIDI data) and the reproduction position of the audio waveform data with reference to FIG. 8 that is a conceptual diagram explanatory of timing deviation correction of the reproduction position. Here, the timing deviation correction will be described in relation to a case where reproduced waveform signals are generated with time stretch control performed on the waveform data of one measure shown in FIG. 3A. Thus, the individual waveform segments w1 to w8 of the audio part shown in FIG. 8 are waveform segments having been subjected to the time stretch control.

In the instant embodiment, at the reference timing of each beat (i.e., beat timing of the MIDI data), a deviation of the current reproduction position of the audio waveform data relative to the reference timing is measured, and, if there is a deviation other than zero (0) or greater than a predetermined threshold value, the current reproduction position of the audio waveform data is corrected in accordance with (by an amount corresponding to) the measured deviation amount so that it can be synchronized with the reference timing (reproduction position of the MIDI data). Namely, whereas the MIDI data are accurately read out and reproduced at a performance tempo designated by the user, the audio waveform data would not necessarily be accurately reproduced at the designated performance tempo because they are influenced by errors caused by the time stretch process. Therefore, in the instant embodiment, the current reproduction position of the audio waveform data is adjusted, using the reproduction position of the MIDI data as the reference timing, to coincide the reference reproduction position of the MIDI data, so as to achieve synchronized reproduction of the waveform data and the MIDI data. As shown in FIG. 8, at the reference timing of the first beat of the first measure (i.e., reproduction timing of the first beat of the MIDI data, which is indicated by "1-1" in the figure), the reference position in the waveform data indicated by the beat information (sb1) coincides with the reference timing "1-1", and there is no "deviation" between the reference reproduction position of the MIDI data and the reproduction position of the waveform data. Therefore, no correction of the reproduction position of the waveform data is made at the correction position (sync point) ss1.

In the illustrated example of FIG. 8, there has occurred a deviation between the reference reproduction position of the MIDI data and the reproduction position of the waveform data at the reference timing of the second beat (1-2) of the first measure. Namely, at the reference timing of the second beat (1-2) of the first measure, the reference position (sb2), in the waveform data, indicated by the beat information (sb2) should be the current reproduction position. However, in the illustrated example of FIG. 8, the waveform segment w2 having been slightly stretched by the time stretch control is still being reproduced at the reference timing of the second beat (1-2) of the first measure, and the reference position (sb2) that is a start position of the next waveform segment w3 has not yet been reached. Thus, at the reference timing of the second beat (1-2) of the first measure, measurement is made of a deviation amount (indicated as Δt1) between the current reproduction position of the currently reproduced waveform segment w2 and the reference position (sb2) indicated by the last beat information (see steps S24 and S25). As an example, the deviation amount (Δt1) is represented by the number of waves or cycles (e.g., 694 waves or cycles).

In response to arrival of the correction position (sync point), in the waveform data, indicated by the first sync point information (ss2) after the reference timing of the second beat (1-2) of the first measure, i.e. in response to arrival of the leading or first reproduction position of the next waveform segment w4, an operation is performed for advancing the current reproduction position of the waveform data by the measured delay amount Δt1 (see steps S27 and S28). Basically, such correction is effected by changing a reproduction position, located later than the first reproduction position of the waveform segment w4 by the delay amount Δt1, to the current reproduction position. It is assumed here that cross-fade synthesis known in the art is applied in order to allow the current reproduction position change to be effected smoothly. Namely, reproduction of the waveform segment w4 is started while being subjected to fade-in control from a position later by the delay amount Δt1 than the first reproduction position of the waveform segment w4 (namely, the first reproduction position of the waveform segment w4 is virtually advanced to a position ss2'), and simultaneously, reproduction of the remaining portion of the preceding waveform w3 is continued while being subjected to fade-out control. By thus interconnecting waveforms to be reproduced per track (see hatched portions in the figure), the instant embodiment allows currently-reproduced waveforms to be switch smoothly at the time of synchronized reproduction. In the aforementioned manner, a reproduction timing deviation of the waveform data relative to the reference timing can be eliminated at the correction position (ss2), so that the current reproduction of the waveform segment w4 is returned to a correct reproduction position corresponding to the performance tempo.

Further, in the illustrated example of FIG. 8, there has occurred a delay "deviation" at the reference timing of the third beat (1-3) of the first measure; the amount of the deviation is represented by Δt2. In this case, at the correction position indicated by the first sync point information (ss3) after the reference timing of the third beat (1-3) of the first measure, an operation is performed for advancing the current reproduction position of the waveform data by the measured deviation or delay amount Δt2 (see steps S27 and S28), similarly to the aforementioned. Namely, reproduction of the succeeding waveform segment w6 is started while being subjected to fade-in control from a position later by the delay amount Δt2 than the first reproduction position of the waveform segment w6 (namely, the first reproduction position of the waveform segment w6 is virtually advanced to a position ss3'), and simultaneously, reproduction of the remaining portion of the preceding waveform w5 is continued while being subjected to fade-out control. Similar operations are performed for the succeeding waveform segments although not described here to avoid unnecessary duplication. Whereas the foregoing paragraphs have described the correction method in relation to the cases where reproduction of the audio waveform data has been delayed behind the reference timing (i.e., tone reproduction based on the MIDI data), correction similar to the aforementioned is performed in cases where reproduction of the audio waveform data has been advanced ahead of the reference timing (tone reproduction based on the MIDI data). Namely, in response to arrival of the correction position indicated by the sync point information, the instant embodiment may perform fade-out control on the currently-reproduced waveform data and simultaneously move forward or delay the current reproduction time of the advanced waveform data by the last measured deviation amount so that reproduction of the waveform data is started while being subjected to fade-in control in another channel.

Whereas the foregoing paragraphs have described the correction method where the last measured deviation is corrected in response to arrival of the correction position indicated by the sync point information (see FIG. 2) for ease of description, the correction method employed in the present invention is not limited to the above. For example, the current reproduction position may be corrected on the basis of an average value between the last and last-but-one measured deviations. Further, it is preferable that an amount of correction at the correction position be changed as necessary in accordance with a frequency of deviation measurement and/or measurement accuracy.

Also note that the correction positions (sync points) and the reference timing (measurement points) need not necessarily correspond to each other in one-to-one relation. Namely, it is not necessary to set one correction position (sync point) per beat. For example, all positions satisfying a predetermined criterion, such as all positions where the amplitude level is smaller than a predetermined value) may be set as correction positions (sync points).

Also note that the correction position information (sync point information) indicative of a correction position (sync point) and stored together with the waveform data may be information defining a correction position (sync point) in accordance with a given condition instead of specifically identifying a particular correction position (sync point). For example, the correction information may be information defining, as a correction position (sync point), a time point when the amplitude level has become smaller than a predetermined value. In such a case, the changing amplitude level is measured at any time so as to detect, in response to the amplitude level having become smaller than the predetermined value, that the correction position (sync point) indicated by the correction position information (sync point information) has arrived, and, in response to such detection, the current reproduction position of the waveform data may be corrected in accordance with a measured deviation.

According to the above-described automatic performance apparatus, beat information (reference position information) indicative of reference positions, in audio waveform data of tones performed in accordance with a reference tempo, corresponding to predetermined reference timing (individual beats in the above-described embodiment) is stored in advance together with the audio waveform data. Also stored in advance is sync point information (correction position information) which is indicative of correction positions obtained by analyzing the audio waveform data and which permits waveform connection much less likely to invite sound quality deterioration when reproduced waveform signals are generated with a timing deviation corrected. When the audio waveform data are to be reproduced in accordance with a variably set tempo, a deviation, relative to the reference timing, of a reproduction position of the audio waveform data is evaluated in accordance with the prestored beat information. For example, if a waveform position of the generated reproduced waveform signal is "940" although the beat information is "1260", it is determined that there has occurred a timing deviation; in this case, an amount of the measured or evaluated timing deviation is "320" (i.e., 1260-940=320).

Then, a correction position for correcting the evaluated deviation amount is identified in accordance with the prestored sync point information, and, at the thus-identified correction position, the current reproduction position of the waveform data is corrected in accordance with the evaluated deviation amount "320". Namely, in accordance with a degree of a deviation (deviation amount) of waveform data reproduction timing (i.e., deviation amount) at each reference timing, the current reproduction position of the waveform data is corrected at the correction position identified in accordance with the prestored sync point information, not at the reference timing. In this way, reproduction timing, relative to the reference timing, of the audio waveform data can be corrected, so that it is possible to prevent sound quality deterioration from being caused by a reproduction timing deviation of the audio waveform data. Namely, only when a deviation has been measured at any one of the reference timing, such a deviation is corrected in response to arrival of correction timing following the one reference timing (where the deviation has been measured), and thus, the present invention can preclude the possibility of causing sound quality deterioration of tones that would involve an unignorable, auditorily-unnatural feeling. Further, by selecting, as the correction position, a position where a switchover of the current reproduction position adversely influences only slightly, the present invention can prevent sound quality deterioration caused by a switchover of the current reproduction position of the audio waveform data. Further, because the present invention can execute audio waveform data reproduction while following the reference timing as faithfully as possible, it can execute synchronized reproduction of audio waveform data and another automatic performance scheme based on MIDI data or the like.

Whereas the present invention has been described above in relation to one preferred embodiment, it is not limited to such an embodiment, and various other embodiments of the present invention are of course possible. For example, whereas the preferred embodiment has been described above in relation to synchronized reproduction of audio waveform data and MIDI data, the present invention is also applicable to synchronized reproduction of different sets of audio waveform data. More specifically, the basic principles of the present invention are also applicable to a disk jockeying (DJ) application where a plurality of different sets of audio waveform data are handled, and other applications where audio reproduction is to be synchronized between a plurality of devices.

Further, it is not necessarily essential to simultaneously start reproduction of different sets of data that are to be reproduced in a synchronized fashion. For example, after reproduction of one set of data (e.g., a set of MIDI data) is started first, and then reproduction of another set of data (e.g., a set of audio waveform data) may be started. In such a case, different beat positions of the two sets of data, e.g. the second beat of one of the sets of data and the first beat of the other set of data, may be synchronized with each other, instead of the two sets of data being synchronized with each other at the same beat (e.g., first beat of the two sets of data) on a measure-by-measure basis.

It should also be noted that the error or deviation measurement may be performed at any desired timing or in any desired fashion, without being limited to the aforementioned beat-by-beat basis, such as on an eighth-note-by-eighth-note basis or on an upbeat-by-upbeat basis, as long as a deviation between a reproduction position of a reference tone (tone based on MIDI data) and a reproduction position of a tone based on audio waveform data can be measured. In such a case, information indicative of positions, in a waveform, corresponding to a plurality of eighth notes or upbeats of individual beats may be stored as the audio part control information.

This application is based on, and claims priority to, JP PA 2012-142891 filed on 26 Jun. 2012. The disclosure of the priority application, in its entirety, including the drawings, claims, and the specification thereof, are incorporated herein by reference.

What is claimed is:

1. An automatic performance apparatus comprising:

a storage section configured to store therein: waveform data; reference position information indicative of reference positions, in the waveform data, corresponding to reference timing specifying a plurality of predetermined time points within a predetermined time length of the waveform data; and correction position information indicative of correction positions in the waveform data that are different from the reference positions;

a reproduction section configured to reproduce the waveform data, stored in said storage section, in accordance with the passage of time;

a measurement section configured to evaluate, in response to arrival of the reference timing, a deviation between a current reproduction position of the waveform data currently reproduced by said reproduction section and the reference position indicated by the reference position information; and a correction section configured to, in response to the current reproduction position of the waveform data arriving at the correction position indicated by the correction position information, correct the current reproduction position of the waveform data, currently reproduced by said reproduction section, in accordance with the deviation evaluated by said measurement section.

2. The automatic performance apparatus as claimed in claim 1, wherein the waveform data stored in said storage section have attached thereto tempo information indicative of a basic tempo.

3. The automatic performance apparatus as claimed in claim 2, which further comprises a tempo setting section configured to variably set a performance tempo, and wherein said reproduction section performs time axial stretch/compression control on the waveform data, which are to be reproduced thereby, in accordance with a ratio between the basic tempo and the performance tempo set by said tempo setting section so that the waveform data are reproduced in accordance with the set performance tempo.

4. The automatic performance apparatus as claimed in claim 1, wherein the correction position information stored in said storage section indicates, as the correction position, a position in the waveform data where an amplitude level is relatively small.

5. The automatic performance apparatus as claimed in claim 4, wherein the correction position information stored in said storage section indicates, as the correction position, a position in the waveform data where the amplitude level is smallest in a region between two adjoining ones of the reference positions.

6. The automatic performance apparatus as claimed in claim 4, wherein the correction position information stored in said storage section indicates, as the correction position, a position in the waveform data where the amplitude level is smaller than a predetermined value.

7. The automatic performance apparatus as claimed in claim 1, wherein, when the current reproduction position of the waveform data is to be corrected by said correction section, said reproduction section performs cross-fade synthesis between the waveform data reproduced from the reproduction position before the correction and the waveform data reproduced from the reproduction position after the correction.

8. The automatic performance apparatus as claimed in claim 1, which further comprises a second reproduction section configured to reproduce a music performance based on control data in synchronism with the reference timing.

9. The automatic performance apparatus as claimed in claim 8, wherein said second reproduction section reproduces a music performance based on MIDI data.

10. The automatic performance apparatus as claimed in claim 1, wherein the waveform data stored in said storage section have a predetermined length corresponding to a given performance pattern, and said reproduction section repetitively reproduces the waveform data.

11. The automatic performance apparatus as claimed in claim 1, wherein the reference positions in the waveform data indicated by the reference position information correspond to beat positions.

12. A computer-implemented method for executing an automatic performance by use of waveform data stored in a storage section, the storage section also storing therein: reference position information indicative of reference positions, in the waveform data, corresponding to reference timing specifying a plurality of predetermined time points within a predetermined time length of the waveform data; and correction position information indicative of correction positions in the waveform data that are different from the reference positions, said method comprising:

a reproduction step of reproducing the waveform data, stored in the storage section, in accordance with the passage of time;

a measurement step of, in response to arrival of the reference timing, evaluating a deviation between a current reproduction position of the waveform data currently reproduced by said reproduction step and the reference position indicated by the reference position information; and a step of, in response to the current reproduction position of the waveform data arriving at the correction position indicated by the correction position information, correcting the current reproduction position of the waveform data, currently reproduced by said reproduction step, in accordance with the deviation evaluated by said measurement step.

13. A non-transitory computer-readable medium containing a program for causing a processor to perform a computer-implemented method for executing an automatic performance by use of waveform data stored in a storage section, the storage section also storing therein: reference position information indicative of reference positions, in the waveform data, corresponding to reference timing specifying a plurality of predetermined time points within a predetermined time length of the waveform data; and correction position information indicative of correction positions in the waveform data that are different from the reference positions, said method comprising:

a reproduction step of reproducing the waveform data, stored in the storage section, in accordance with the passage of time;

a measurement step of, in response to arrival of the reference timing, evaluating a deviation between a current reproduction position of the waveform data currently reproduced by said reproduction step and the reference position indicated by the reference position information; and a step of, in response to the current reproduction position of the waveform data arriving at the correction position indicated by the correction position information, correcting the current reproduction position of the waveform data, currently reproduced by said reproduction step, in accordance with the deviation evaluated by said measurement step.

* * * * *